US005165490A

United States Patent [19]

Nosaka

[11] Patent Number: 5,165,490

[45] Date of Patent: Nov. 24, 1992

[54] BORING TOOL HAVING ELECTROMAGNETIC WAVE GENERATION CAPABILITY

[75] Inventor: Masao Nosaka, Iwakura, Japan

[73] Assignee: Takachiho Sangyo Kabushiki Kaisha, Aichi, Japan

[21] Appl. No.: 769,537

[22] Filed: Oct. 1, 1991

[30] Foreign Application Priority Data

Oct. 3, 1990 [JP] Japan ..... 2-266023

[51] Int. Cl.[5] ..... E21B 7/04; E21B 47/024

[52] U.S. Cl. ..... 175/45; 324/346; 405/184

[58] Field of Search ..... 175/24, 45, 61, 62; 405/184; 324/346

[56] References Cited

U.S. PATENT DOCUMENTS 3,746,106 7/1973 McCullough et al. ..... 175/45
4,787,463 11/1988 Geller et al. ..... 175/45
4,907,658 3/1990 Stangl et al. ..... 175/45 X
5,002,137 3/1991 Dickinson et al. ..... 175/45 X

FOREIGN PATENT DOCUMENTS 3900122 7/1990 Fed. Rep. of Germany ..... 175/45

*Primary Examiner*—David J. Bagnell
*Attorney, Agent, or Firm*—Palmatier & Sjoquist

[57] ABSTRACT

A boring head for boring the ground includes a housing of substantially cylindrical configuration. An electric power source, a coil, a switch and an oscillator are mounted within the housing. The coil generates an electromagnetic wave, and the oscillator is connected with the power source, the coil and the switch. The switch is operable to be switched according to an angular position of the housing in a circumferential direction as to whether the angular position is within a predetermined range. The configuration of the electromagnetic wave generated by the coil can be changed through the switch according to the angular position of the housing.

10 Claims, 4 Drawing Sheets

BORING TOOL HAVING ELECTROMAGNETIC WAVE GENERATION CAPABILITY

BACKGROUND OF THE INVENTION

1. Field of the Invention

The present invention relates to a boring head of a boring machine.

2. Description of the Prior Art

A conventional boring machine includes a boring head which is connected with the boring machine through pilot tubes under ground. The boring head is normally rotated with the pilot tubes and is pushed forwardly in a longitudinal direction of the pilot tubes.

With such boring operation, however, the direction of the boring head may be deviated from a planned course. In such a case, it is necessary to correct the course of the boring head.

In such a case, a position of the boring head in both horizontal and vertical directions is measured by a depth sensor utilizing liquid or a magnetic sensor mounted within the boring head. The output of the sensor is transmitted to a wayside control device via a cable extending through the pilot tubes. The boring head includes at the forward portion thereof a rotary member which is rotatable around the longitudinal axis of the boring head by a motor disposed within the boring head and is provided with a slant surface inclined at a predetermined angle relative to a longitudinal direction. As the boring head is pushed forwardly by the boring machine, the boring head moves in the longitudinal direction when the rotary member is rotated, while the boring head moves obliquely according to the position of the slant surface when the rotary member is not rotated. Based on the output of the sensor, the control device calculates an appropriate position of the inclined surface for compensating the displacement of the position of the boring head from the planned course. The control device thereafter outputs the corresponding signal to the motor for rotation of the rotary member so as to position the slant surface at the appropriate position. After positioning the slant surface, another pilot pipe is connected with the previously connected pilot pipe for subsequent pushing operation by the boring machine.

However, the conventional device for measuring the position of the slant surface and rotating the rotary member becomes difficult to be disposed within the boring head as the boring head as well as the pilot tubes becomes to have a smaller diameter. In fact, it is substantially impossible to dispose such a device within the boring head having a diameter less than 50 mm.

Therefore, practically, the rotary member and the motor is not provided with the boring head and only the sensor and the inclined surface are provided with the boring head. In such a case, rotation of the slant surface is made by rotating the boring head with the pilot tubes by the boring machine. The angle of rotation of the boring head is determined based on the position of the slant surface when the boring operation has been started. However, the pilot tubes are normally threadably connected with each other, and therefore, the angle of rotation of the boring head to be expected does not accurately correspond to that of the angle of actual rotation of the boring head because of the possible displacement between the contiguous pilot tubes during rotation. Further, since the pilot tubes must be subsequently pushed by the boring machine from a limited space, they must have relatively short length. Therefore, the difference between the angle of rotation to be expected and that of the actual rotation of the boring head further increases. For this reason, it is not possible to accurately position the inclined surface at the appropriate position. Therefore, in the conventional device of this type, it is necessary to move the boring head at a short distance after positioning of the slant surface, and to subsequently measure the actual position of the boring head for further correction of direction when the boring head is not on the planned course.

Additionally, with the above conventional devices, it requires to pass the cable for transmitting the output of the sensor to the wayside control device, and therefore, the operation must be carefully performed not to damage the cable.

SUMMARY OF THE INVENTION

It is, accordingly, an object of the present invention to provide a boring head of a boring machine which does not require a cable for transmitting to a wayside device an output signal of an angular position of a slant surface in a circumferential direction.

It is another object of the present invention to provide a boring head of a boring machine including therein a device for outputting an electromagnetic wave which corresponds to an angular position of the boring head and which can be detected on the ground.

According to the present invention, there is provided a boring head for boring the ground comprising:

a housing of substantially cylindrical configuration;

an electric power source mounted within the housing;

a coil mounted within the housing for generating an electromagnetic wave;

a switch mounted within the housing for switching according to an angular position of the housing in a circumferential direction as to whether the angular position is within a predetermined range; and an oscillator mounted within the housing and connected with the power source, the coil and the switch;

whereby the configuration of the electromagnetic wave generated by the coil can be changed through the switch according to the angular position of the housing.

The invention will become more fully apparent from the claims and the description as it proceeds in connection with the drawings.

DETAILED DESCRIPTION OF THE PREFERRED EMBODIMENT

Figure 1:
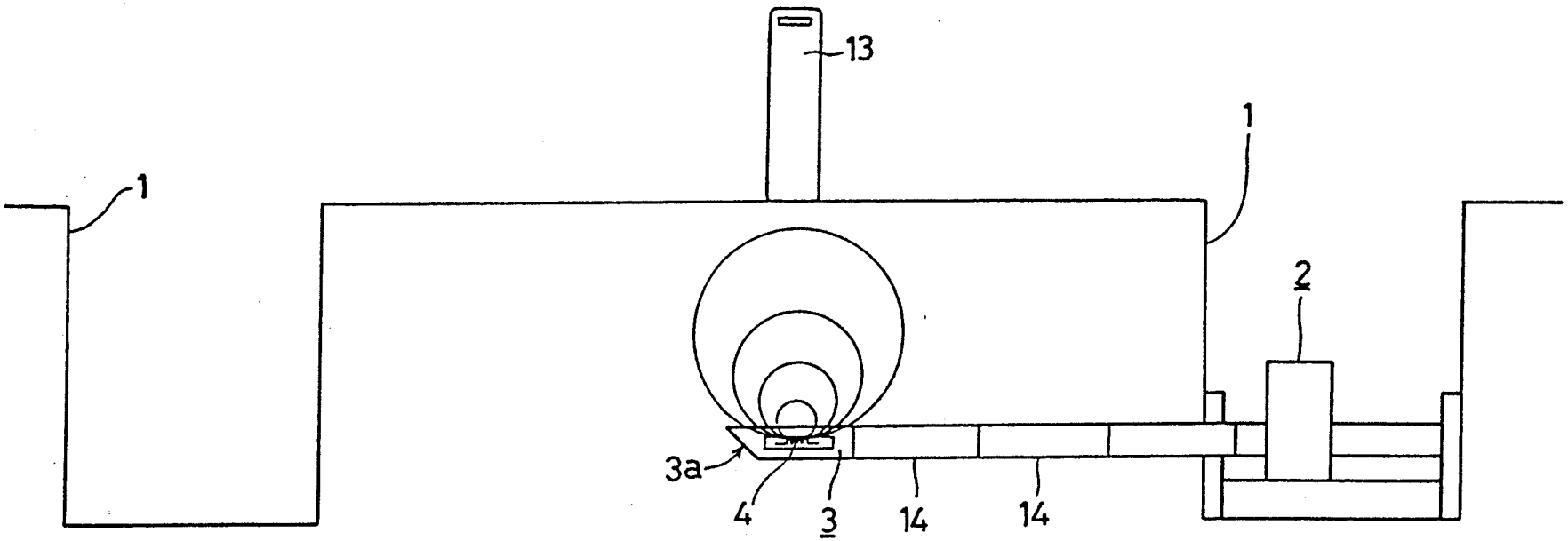
FIG. 1 is a schematic front view of a boring head in an operative position.
Figure 2:
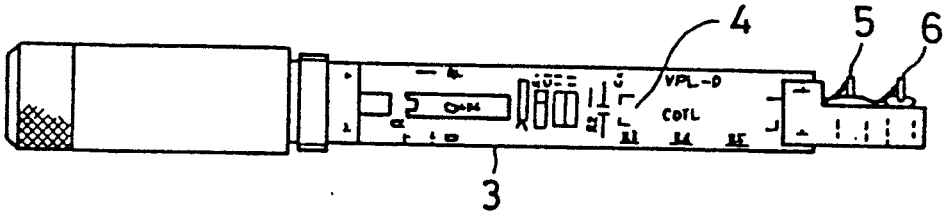
FIG. 2 is an enlarged front view of the boring head shown in FIG. 1.
Figure 3:
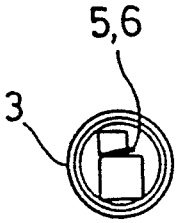
FIG. 3 is a right side view of FIG. 2.

Referring to FIG. 1, there is shown a boring head 3 according to an embodiment of the present invention.

The boring head 3 is rotated and moved to bore the ground in a horizontal direction. To rotate and move the boring head 3, a boring machine 2 is located within a shaft 1 formed in the ground and forces the boring head 3. A plurality of pilot tubes 14 are interposed between the boring machine 2 and the boring head 3. The pilot tubes 14 are in turn joined to the rear portion of the boring head 3 as the boring head 3 are pushed forwardly. The boring head 3 includes a slant surface 3*a* at its forward portion, so that the direction of movement of the boring head 3 can be changed by the angular displacement of the slant surface 3*a*. Thus, in case that the slant surface 3*a* is in a position shown in FIG. 1, the boring head 3 is moved upwardly when it is pushed by the boring machine 2.

Figure 4:
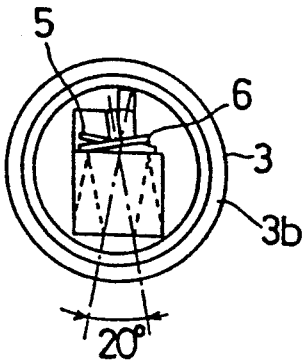
FIG. 4 is a more detailed view of FIG. 3.
Figure 5A:
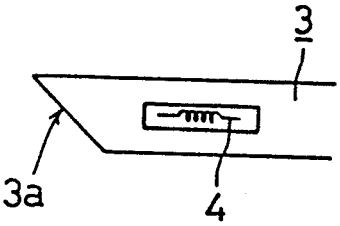
FIG. 5A is a schematic front view of the boring head similar to FIG. 1.
Figure 5B:
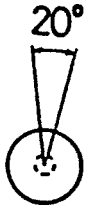
FIG. 5B is a schematic view showing the range of angular position of the boring head where one of switches is on and the other of the switches is off.
Figure 5C:
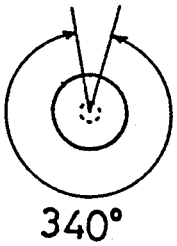
FIG. 5C is a view similar to FIG. 5B but showing the range of the angular position of the boring head where both the switches are on or off.

The boring head 3 includes a transmitter 4 for generating an electromagnetic wave and a pair of switches 5, 6 for alternating a wave configuration of the electromagnetic wave from the transmitter 4 in such a manner that the electromagnetic wave has a different configuration in case that the angular position of the boring head 3 around its axis is within a predetermined range and in case that the angular position is out of the predetermined range. In this embodiment, each of the switches 5, 6 is a mercury switch which turns on to off or vice versa at a predetermined inclination. As shown in FIG. 4, the switches 5, 6 are mounted on the boring head 3 and are angularly displaced from a central line thereof in a radial direction at an angle of 10° in opposite directions, respectively. The switches 5, 6 are displaced from each other at an angle of 20°. With this construction, one of the switches 5, 6 is on and the other is off when the boring head 3 is positioned within a predetermined angular range. Thus, the switches 5, 6 function as gravity sensitive switches.

Figure 6:
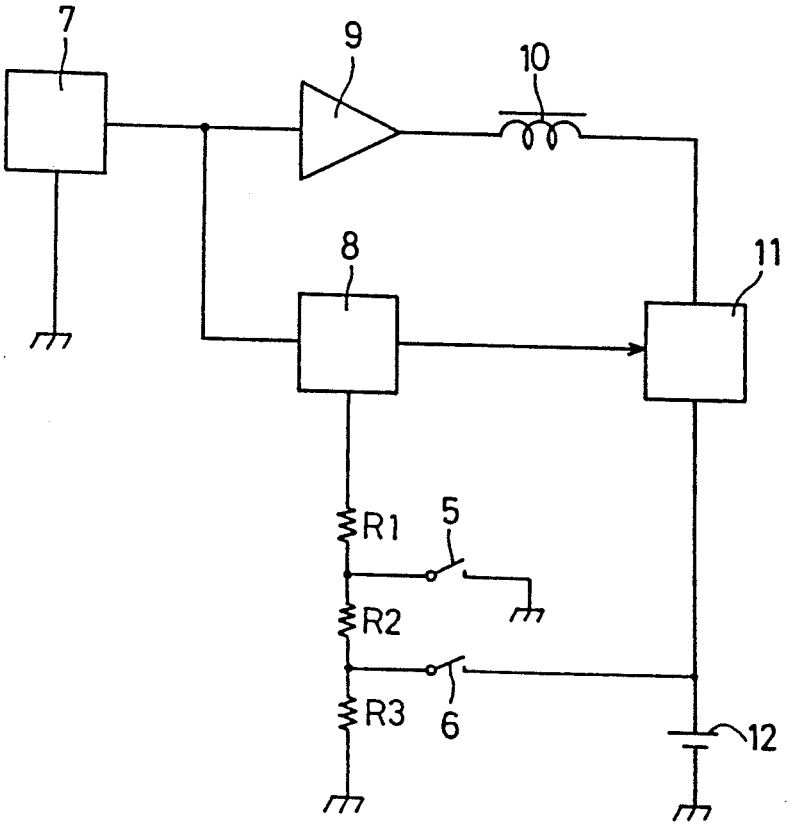
FIG. 6 is a block diagram of a transmitter shown in FIG. 1.
Figure 8:
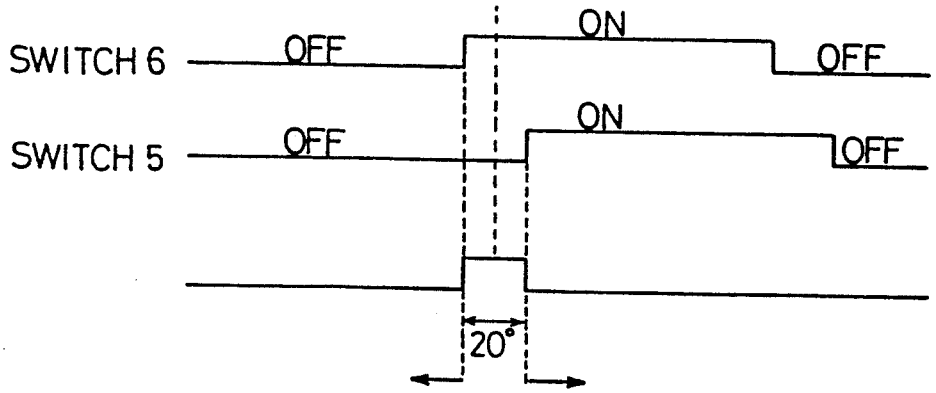
FIG. 8 shows a timing chart of turning of the switches shown in FIGS. 3 and 4.

As shown in FIG. 6, the transmitter 4 includes an oscillating circuit 7 for outputting an output signal having a predetermined frequency. The output signal from the oscillating circuit 7 is inputted to a dividing circuit 8 and also to an amplifying circuit 9. The amplified output of the amplifying circuit 9 is inputted to a coil 10 for generating a magnetic field.

The dividing circuit 8 divides the output signal from the oscillating circuit 7 at an appropriate ratio and its output signal is inputted to an intermitting circuit 11. The dividing circuit 8 includes a control terminal for starting and stopping a dividing operation when the voltage applied to the terminal is LOW and HIGH, respectively. The terminal is connected to the ground through resistors RI, R2 and R3. The connecting point between the resistors R1 and R2 is connected with the ground through the switch 5 which turns on to off or vice versa as the boring head 3 rotates at an angle of 180°. The connecting point between the resistors R2 and R3 is connected with a positive terminal of a battery 12 through the switch 6 which also turns on to off or vice versa as the boring head 3 rotates at an angle of 180°. The battery 12 is disposed within the boring head 3.

Returning to FIG. 4, the boring head 3 has a housing 3*b* of substantially cylindrical configuration, and the switches 5, 6 are mounted within the housing 3*b* and are inclined to each other at an angle of 20° as previously described. As the boring head 3 rotates from a position where both the switches 5, 6 are off, the switch 6 turns on while the switch 5 is kept off, and thereafter the switch 5 also turns on. Thus, the period where the switch 6 is on and the switch 5 is off continues during the rotation of the boring head 3 at an angle of 20°.

As will be seen from FIG. 6, the LOW signal is inputted to the dividing circuit 8 when the switch 5 is on or when the switch 6 is off, while the HIGH signal is inputted to the dividing circuit 8 only the time when the switch 5 is on and the switch 6 is off.

When the HIGH signal is applied to the control terminal of the dividing circuit 8, the intermitting circuit 11 becomes continuously on, and a current having a frequency as that outputted from the oscillating circuit 7 flows through the coil 10. On the other hand, when the LOW signal is applied to the control terminal of the dividing circuit 8, the intermitting circuit 11 intermittingly turns on, so that the current intermittingly flows through the coil 10.

Figure 7:
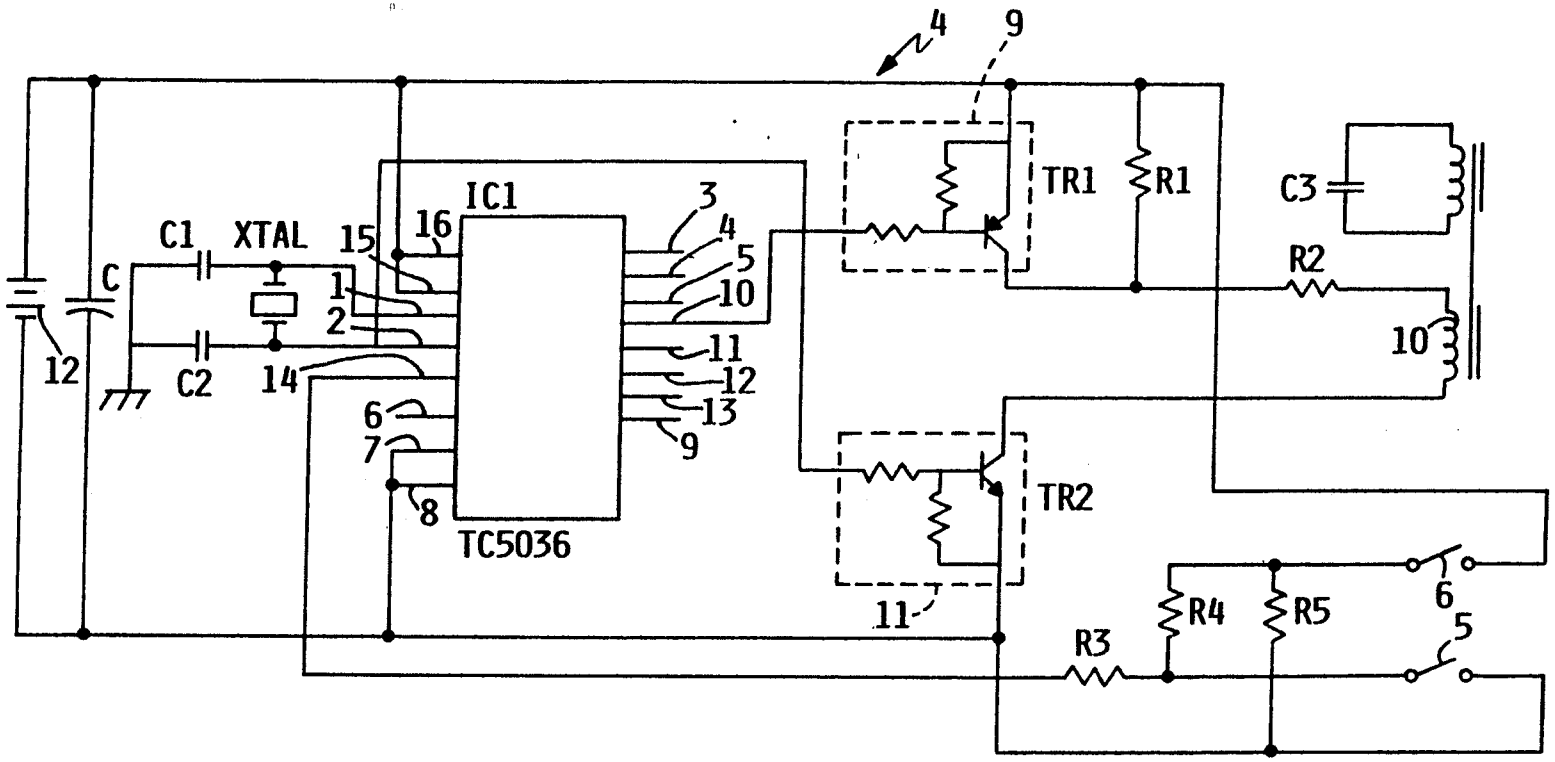
FIG. 7 shows a circuit configuration of the transmitter shown in FIG. 6.

FIG. 7 shows a practical circuit configuration of the transmitter 4. In FIG. 7, the dividing circuit 8 shown in FIG. 6 is constructed as an IC named as Tc5036P. By connecting with XTAL, the one chip IC involves an oscillating circuit same as the oscillating circuit 7 and performs an oscillating function, a dividing function and a function to start or stop dividing. The oscillating signal of the IC has a frequency of 38 KHz, and the divided signal has a frequency of 2.32 KHz or is divided into 14 divisions.

An output terminal XT of the oscillating signal is inputted to a transistor TR2 which forms a tank circuit together with a circuit of the coil 10.

An output terminal Q14 of the divided signal is inputted to a transistor TR1 which is directly connected with the tank circuit. An intermitting signal is outputted from the transistor TR1 since the limitation of current by the resistor R1 is intermitted through turning of the transistor TR1.

On the other hand, the dividing function is stopped when the HIGH signal is applied to a reset terminal RES of the above IC, so that the transistor TR1 becomes continuously on. Thus, the transistor TR1 outputs a continuous signal. Here, the HIGH signal is applied to the reset terminal RES only the time when the switch 5 is off and the switch 6 is on.

The operation of the above embodiment will now be explained.

When the angular position of the slant surface 3*a* of the boring head 3 is out of the predetermined range, both the switches 5, 6 become on or off, and the LOW signal is applied to the reset terminal RES to output the divided signal. Thus, the transmitter 4 outputs the intermitting signal which may be received by a receiver 13 on the ground, so that an operator can recognize that the slant surface 3*a* of the boring head 3 is out of the predetermined angle.

The operator thereafter roughly surveys the position of the boring head 3 through the receiver 13 and rotates the pilot tubes 14 until the continuous signal is outputted from the transmitter 4 or until the switches 5, 6 become off and on, respectively, and the HIGH signal is applied to the reset terminal RES of the IC so as to stop the output of the divided signal.

With the above embodiment, the operator can easily detect the angular position of the slant surface 3*a* of the boring head 3. Further, based on the continuous signal received by the receiver 13, the depth at which the boring head 3 is positioned can be easily measured by a known technique for calculating depth based on input signals received by a receiver from the magnetic fields positioned at different levels. Additionally, the battery 12 as a power source of the transmitter 4 is disposed within the boring head 3, and the output signal of the angular position of the boring head 3 can be detected by the receiver 13 located on the ground without utilizing a cable. Thus, it is not necessary to connect the boring head 3 with a cable for transmitting the output signal, and therefore, the operation within the shaft 1 for connecting the pilot tubes 14 can be easily made without care for damage of the cable.

While the invention has been described with reference to a preferred embodiment thereof, it is to be understood that modifications or variations may be easily made without departing from the scope of the present invention which is defined by the appended claims.

What is claimed is:

1. A boring head for boring the ground comprising:
a housing of substantially cylindrical configuration;
an electric power source mounted within said housing;
a coil mounted within said housing for generating an electromagnetic wave;
switch means mounted within said housing for switching according to an angular position of said housing in a circumferential direction. as to whether the angular position is within a predetermined range; said switch means including a pair of switches capable of being turned on or off by gravity, said switches being disposed in said housing and inclined at a predetermined angle relative to each other; whereby one of said switches turns on and the other of said switches turns off when the angular position of said housing is within said predetermined range, and both of said switches turn on or off when the angular position of said housing is outside said predetermined range; and
an oscillator mounted within said housing and connected with said power source, said coil and said switch means;
whereby the configuration of said electromagnetic wave generated by said coil can be changed through said switch means according to the angular position of said housing.

2. The boring head as defined in claim 1 wherein said switches are mercury switches.

3. The boring head as defined in claim 1 wherein said switches are inclined relative to each other at an angle of 20°.

4. The boring head as defined in claim 1 and further including a dividing circuit mounted within said housing; said dividing circuit includes an input terminal, an output terminal and a control terminal; said input terminal is connected with said oscillator and said control terminal is connected with said switch means.

5. The boring head as defined in claim 1 further including a dividing circuit mounted within said housing; said dividing circuit includes an input terminal, an output terminal and a control terminal; said input terminal is connected with said oscillator, said control terminal is connected with said switches; a high signal is inputted to said control terminal when one of said switches is on and the other of said switches is off where the angular position of said housing is within said predetermined range; and a low signal is inputted to said control terminal when both said switches are on or off where the angular position of said housing is out of said predetermined range.

6. The boring head as defined in claim 5 wherein said dividing circuit generates a constant signal when said high signal is inputted to said control terminal and wherein said dividing circuit generates a divided signal when said low signal is inputted to said control terminal.

7. The boring head as defined in claim 6 further including an intermitting circuit connected in series with said power source, said oscillator and said coil for generating said electromagnetic wave; said intermitting circuit being connected with said output terminal of said dividing circuit and operable to be turned according to the output voltage of said output terminal.

8. A boring head for boring the ground comprising:
a housing of substantially cylindrical configuration;
an electric power source mounted within said housing;
a coil mounted within said housing for generating an electromagnetic wave.
an oscillator mounted within said housing and connected with said power source;
switch means mounted within said housing for switching according to an angular position of said housing in a circumferential direction as to whether the angular position is within a predetermined range;
an intermitting circuit mounted within said housing and connected in series with said coil and said power source;
a dividing circuit mounted within said housing and including an input terminal, an output terminal and a control terminal, said input terminal being connected with said oscillator, said output terminal being connected with said intermitting circuit and said control terminal being connected with said switch means, said dividing circuit being operable to continuously output a voltage to keep said intermitting circuit on when the angular position of said housing is within said predetermined range, while said dividing circuit being operable to output a voltage to intermittently turn on or off said intermitting circuit at the divided frequency.

9. The boring head as defined in claim 8 wherein said switch means include a pair of switches to be turned on or off by gravity; said switches are mounted within said housing and inclined relative to each other at a predetermined distance; a high signal is inputted to said control terminal of said dividing circuit when one of said switches is on and the other of said switches is off where the angular position of said housing is within said predetermined range; and a low signal is inputted to said control terminal when both said switches are on or off where the angular position of said housing is out of said predetermined range.

10. The boring head as defined in claim 8 wherein said housing includes at the forward portion thereof a slant surface, so that the boring direction can be changed by changing the angular position of said slant surface.

* * * * *